US009570854B2

(12) United States Patent
Hashimoto

(10) Patent No.: US 9,570,854 B2
(45) Date of Patent: Feb. 14, 2017

(54) TERMINAL FITTING WITH STABILIZERS AND CONNECTOR

(71) Applicant: Sumitomo Wiring Systems, Ltd., Yokkaichi, Mie (JP)

(72) Inventor: Norihito Hashimoto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 30 days.

(21) Appl. No.: 14/624,648

(22) Filed: Feb. 18, 2015

(65) Prior Publication Data

US 2015/0263456 A1 Sep. 17, 2015

(30) Foreign Application Priority Data

Mar. 13, 2014 (JP) ..... 2014-050508

(51) Int. Cl.
*H01R 13/40* (2006.01)
*H01R 13/642* (2006.01)
*H01R 13/11* (2006.01)

(52) U.S. Cl.
CPC ..... *H01R 13/642* (2013.01); *H01R 13/113* (2013.01)

(58) Field of Classification Search
CPC ..... H01R 9/2416
USPC ..... 439/752.5
See application file for complete search history.

(56) References Cited

U.S. PATENT DOCUMENTS 5,860,836 A * 1/1999 Ohno ..... H01R 13/4223 439/752.5
5,928,034 A * 7/1999 Tabata ..... H01R 13/4365 439/595
7,144,281 B2 * 12/2006 Maeda ..... H01R 43/16 439/595
7,198,525 B2 * 4/2007 Nagamine ..... H01R 12/721 439/843
8,366,494 B2 * 2/2013 Nishide ..... H01R 13/113 439/752.5
8,388,388 B2 * 3/2013 Suzuki ..... H01R 13/113 439/752.5
2010/0317212 A1 * 12/2010 Daily ..... F21K 9/17 439/230
2015/0263456 A1 * 9/2015 Hashimoto ..... H01R 13/113 439/752.5

* cited by examiner

*Primary Examiner* — Neil Abrams
(74) *Attorney, Agent, or Firm* — Gerald E. Hespos; Michael J. Porco; Matthew T. Hespos

(57) ABSTRACT

First and second stabilizers (26, 33) project on a main body (11) of a terminal fitting (10) while being spaced apart in a direction intersecting with a front-back direction. The first stabilizer (26) has a front end extending steeply in a direction substantially perpendicular to the front-back direction and the second stabilizer (33) has a front end part (38) inclined to recede. The front end part (38) of the second stabilizer (33) is more forward than the first stabilizer (26) so that the front end of the second stabilizer contacts a facing wall surface of a connector housing (60) before the first stabilizer (26) when an insertion posture is incorrect.

3 Claims, 8 Drawing Sheets

TERMINAL FITTING WITH STABILIZERS AND CONNECTOR

BACKGROUND

1. Field of the Invention

The invention relates to a terminal fitting and a connector with a terminal fitting.

2. Description of the Related Art

U.S. Pat. No. 8,366,494 discloses a terminal fitting that is inserted into a cavity of a connector housing from behind and includes a rectangular tubular main body to be locked resiliently by a locking lance formed at an inner wall of the cavity. Two stabilizers project from the main body while being spaced apart in a front-back direction. Guiding grooves are formed in the housing and communicate with the cavity to guide an insertion of a properly oriented terminal fitting into the cavity. However, the stabilizers contact a surface of the housing if the terminal fitting is oriented improperly to prevent complete insertion of the terminal fitting. The front ends of the stabilizers have surfaces extending steeply in a direction intersecting the front-back direction.

Front ends of the stabilizers may scrape off the facing wall surface of the housing and damage the housing if the terminal fitting is pushed forcibly into the cavity of the housing when the main body is in an incorrect insertion posture. A possibility of scraping off the facing wall surface of the connector housing can be reduced if the front ends of the stabilizers are inclined to recede toward projecting ends. However, the inclined front ends of the stabilizers may slide on the facing wall surface of the housing and it may not be possible to stop the insertion of the improperly oriented terminal fitting.

The present invention was completed based on the above situation and aims to prevent an inverted insertion preventing function of a terminal fitting with no problem.

SUMMARY OF THE INVENTION

The invention is directed to a terminal fitting, including a tubular main body to be inserted into a cavity of a connector housing from behind. Stabilizers project on the main body while being spaced apart in a direction intersecting a front-back direction, an inserting operation into the cavity is guided by entrance of the stabilizers into guiding grooves that communicate with the cavity in the housing. On the other hand, insertion is stopped by contact of a front end part of the stabilizer with a facing wall surface of the housing when an insertion posture is incorrect. The stabilizers include a first stabilizer having a front end extending steeply in a direction substantially perpendicular to the front-back direction and a second stabilizer having a front end inclined to recede. A front end position of the front end of the second stabilizer is set before the first stabilizer so that the front end of the second stabilizer contacts the facing wall surface of the housing earlier than the first stabilizer when the insertion posture is incorrect.

The front end of the second stabilizer contacts the facing wall surface of the housing to stop the inserting operation of the terminal fitting if the terminal fitting is pushed into the cavity when the main body in an incorrect insertion posture. The front end of the second stabilizer is inclined to recede. Hence, there is little likelihood of damaging the facing wall surface of the housing. The front end part of the first stabilizer contacts the facing wall surface of the housing if the front end of the second stabilizer should slide on the facing wall surface of the housing. Thus, the inserting operation of the terminal fitting in the incorrect posture is stopped reliably. The front end of the first stabilizer extends steeply in the direction substantially perpendicular to the front-back direction. Therefore, the insertion of the terminal fitting is stopped with high reliability. In this case, the front end of the second stabilizer contacts the facing wall surface of the housing earlier than the first stabilizer, thereby reducing a contact force (impact force) of the first stabilizer with the housing. Thus, there is little likelihood of damaging the facing wall surface of the housing. With this configuration, an inverted insertion preventing function of the terminal fitting can be exhibited with no problem.

The first stabilizer is formed by cutting and bending a plate piece formed by a cut on the main body, and the front end of the first stabilizer is formed by a surface of the plate piece in a plate thickness direction. Accordingly, the front end of the first stabilizer extends steeply in the direction substantially perpendicular to the front-back direction.

The rear end of the first stabilizer defines a lance receiving portion that contacts a locking lance formed in the cavity of the housing to prevent the terminal fitting from coming out of the cavity. Thus, the first stabilizer also has a function as the lance receiving portion, and the entire configuration can be simplified as compared with the case where a dedicated lance receiving portion is provided separately.

The invention also is directed to a connector with the above-described terminal fitting. A rear part of the cavity of the housing is formed as a rubber plug accommodating portion and has a larger diameter than a front part of the cavity. The cavity of the housing has a tapered guiding surface gradually reduced in diameter from the rear part to the front part. The front end of the stabilizer contacts the tapered guiding surface when the main body is in an incorrect insertion posture, and there is a relatively high possibility that the front end of the second stabilizer will slide on the guiding surface without stopping the inserting operation of the terminal fitting in an incorrect posture. However, the inserting operation of the terminal fitting in an incorrect posture can be stopped reliably by the contact of the front end of the first stabilizer with the guiding surface.

DETAILED DESCRIPTION OF THE PREFERRED EMBODIMENTS

A terminal fitting 10 according to an embodiment of the invention is identified by the numeral 10 in FIGS. 1 to 8. The terminal fitting 10 is formed unitarily by bending an electrically conductive metal plate that is long and narrow in a front-back direction. The terminal fitting 10 is inserted into a cavity 61 of a connector housing 60 shown in FIG. 8 from behind (from a right side in FIG. 8) and retained and held in the cavity 61.

Figure 8:
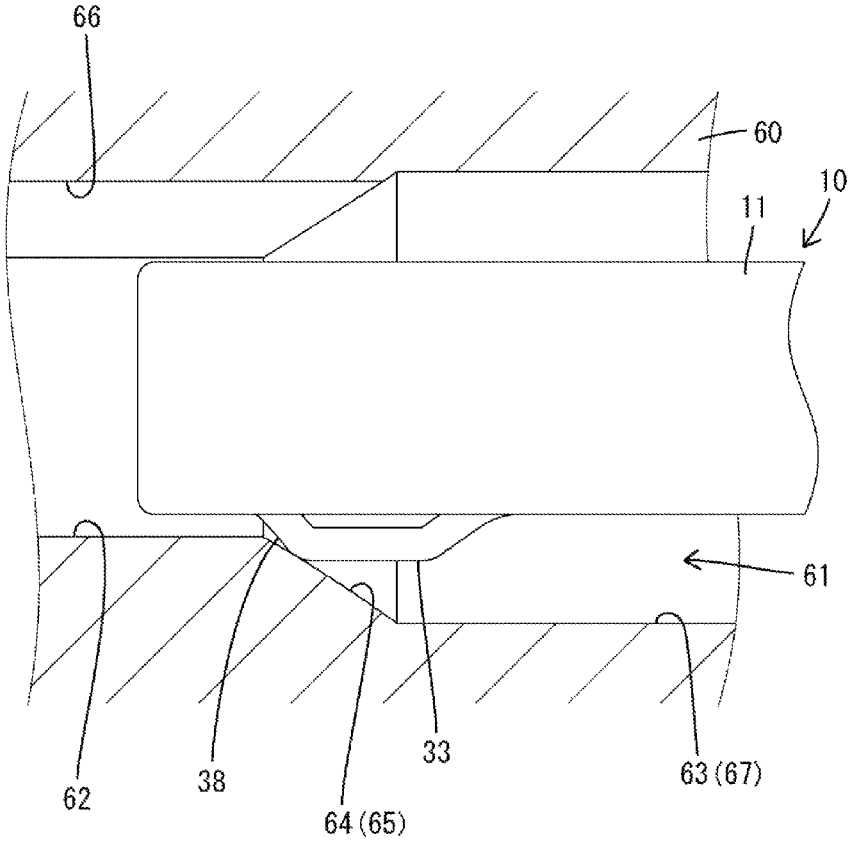
FIG. 8 is a conceptual diagram showing a state where a second stabilizer is in contact with a facing inclined surface of a connector housing.

The housing 60 is made of synthetic resin and the cavity 61 extends therethrough in the front-back direction, as shown in FIG. 8. The cavity 61 includes a front part 62 located on a front end, a rear part 63 located on a rear end and an intermediate part 64 located between the front and rear parts 63 and 64. The rear part 63 is cross-sectionally larger than the front part 62. The front part 62 of the cavity 61 has a substantially rectangular cross-section dimensioned to receive a main body 11 of the terminal fitting 10. An unillustrated deflectable locking lance is provided in the front part 62 of the cavity 61 and is capable of retaining and locking the terminal fitting 10. The rear part 63 of the cavity 61 has a circular cross-sectional shape and serves as a rubber plug accommodating portion 67 for receiving a rubber plug connected to the terminal fitting 10. The intermediate part 64 of the cavity 61 has a tapered guiding surface 65 (facing wall surface of the connector 60) gradually reduced in diameter from the rear part 63 to the front part 62.

The housing 60 includes two guiding grooves 66 extending in the front-back direction and opening into the front part 62 of the cavity 61, as shown in FIG. 8. Each guiding groove 66 has a substantially rectangular cross-section and a depth to be accommodated within the width of the rear part 63 when viewed from behind. One of the guiding grooves 66 is formed by recessing the upper wall of the cavity 61 and can receive a first stabilizer 26. The other guiding groove 66 is formed by recessing a side wall of the cavity 61 and can receive a second stabilizer 33.

Figure 1:
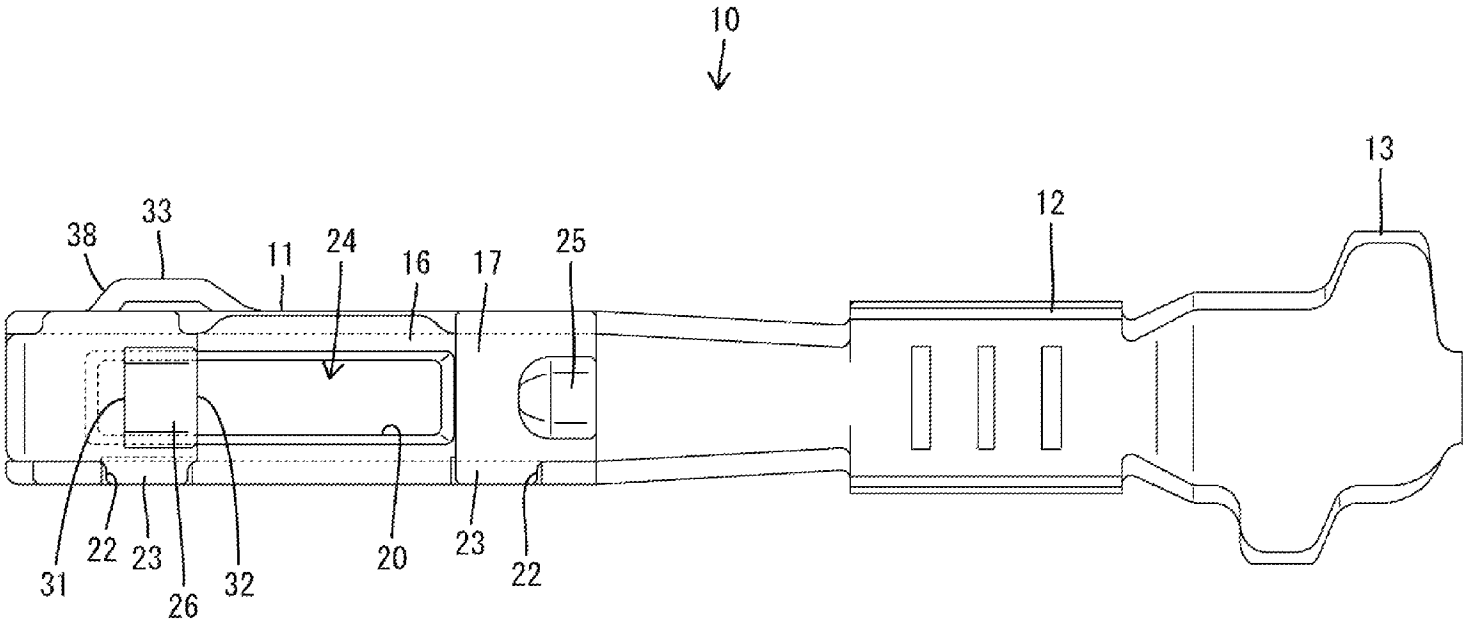
FIG. 1 is a plan view of a terminal fitting according to an embodiment of the present invention.
Figure 2:
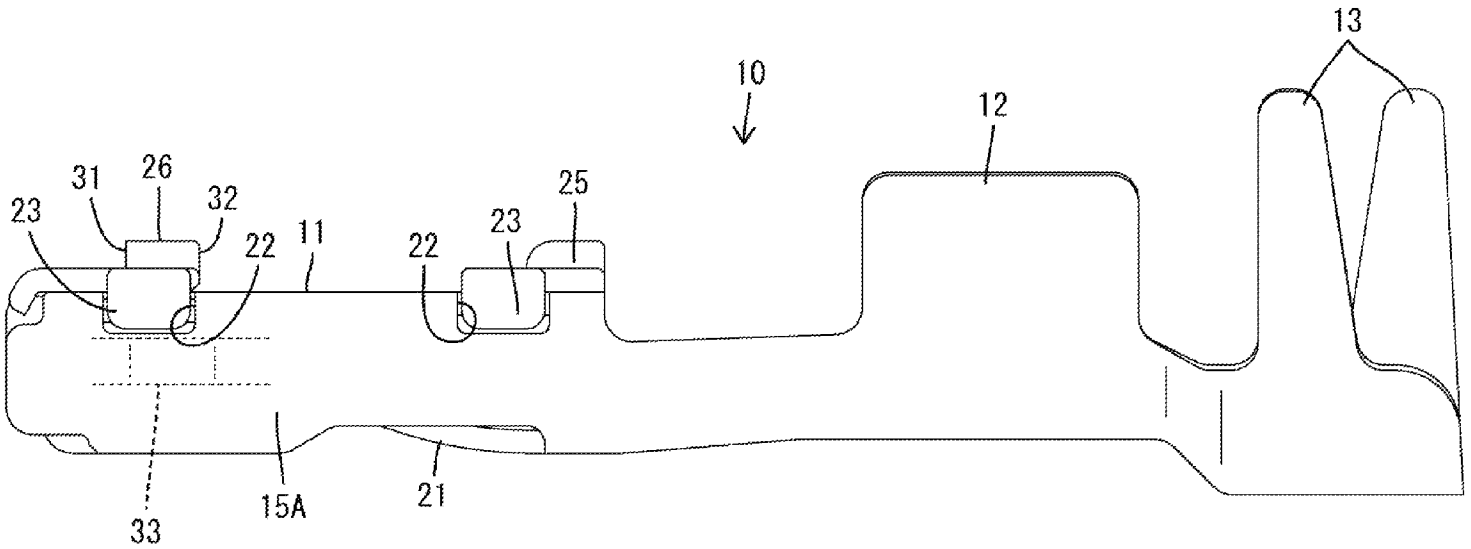
FIG. 2 is a left side view of the terminal fitting.

As shown in FIGS. 1 and 2, the terminal fitting 10 includes the main body 11, a wire barrel 12 connected to and behind the main body 11 and an insulation barrel 13 connected to and behind the wire barrel 12. The wire barrel 12 is connected by crimping to a core exposed by removing a coating at an end of an unillustrated wire. The insulation barrel 13 is connected by crimping to the unillustrated rubber plug externally fit on the coating on the end part of the wire. The rubber plug is held resiliently in close contact with the outer peripheral surface of the wire and also is held resiliently in close contact with the inner peripheral surface of the rubber plug accommodating portion 67 when the terminal fitting 10 is inserted properly in the cavity 61. In this way, sealing is provided between the housing 60 and the wire in a liquid-tight manner.

Figure 5:
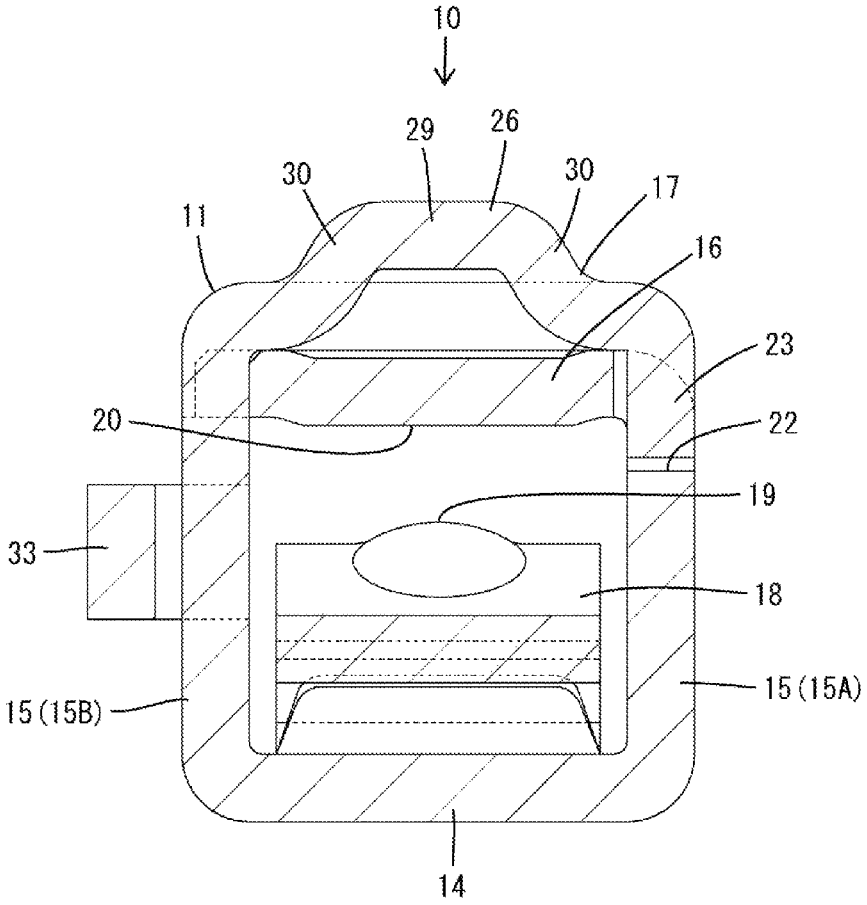
FIG. 5 is a section along A-A of FIG. 4.

The main body 11 is a substantially rectangular tube and, as shown in FIG. 5, includes a base wall 14, first and second side walls 15A, 15B standing up from opposite widthwise sides of the base wall 14, a first bridging wall 16 extending from the upper end of the first side wall 15A to the second side wall 15B and a second bridging wall 17 extending from the upper end of the second side wall 15B to the first side wall 15A and placed on the first bridging wall 16 to cover the upper surface of the first bridging wall 16.

Figure 4:
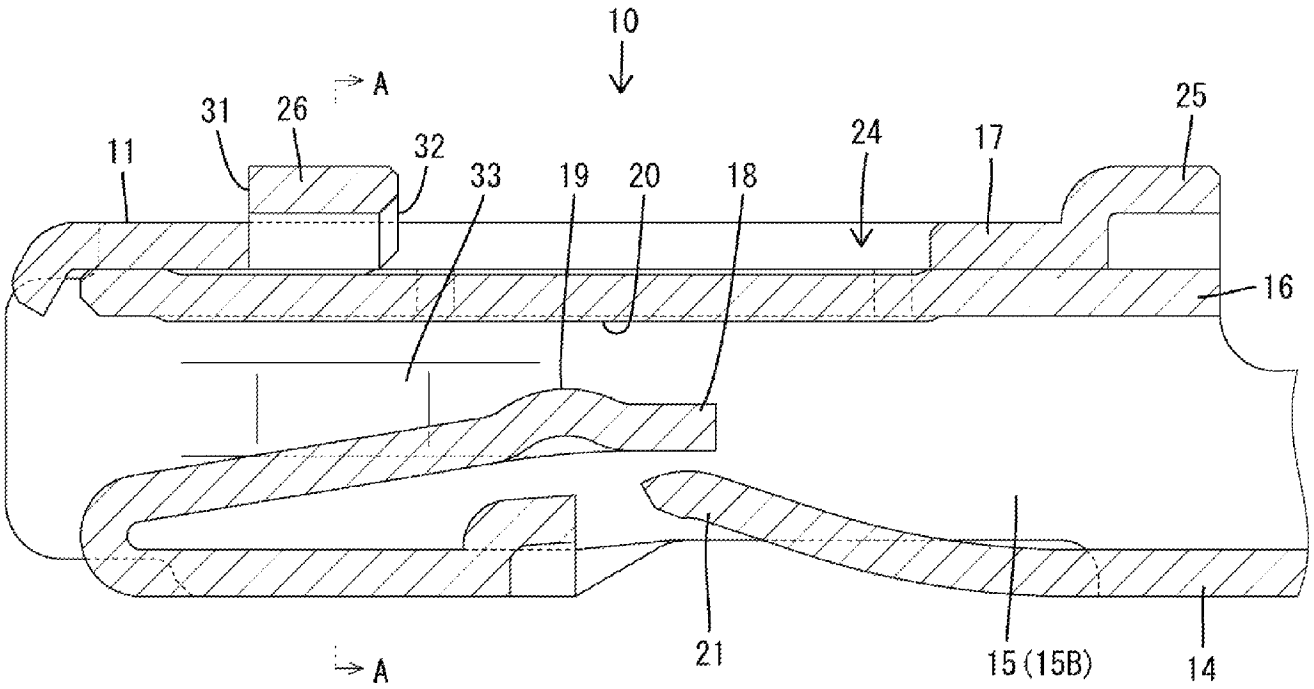
FIG. 4 is an enlarged side view in section of a part of the terminal fitting.

As shown in FIG. 4, a resilient contact piece 18 in the form of a strip is folded back from the front end of the base wall 14 into the main body 11. The resilient contact piece 18 is resiliently deformable toward the base wall 14 with the front end of the base wall 14 as a support. The resilient contact piece 18 includes an embossed contact portion 19 projecting up. The first bridging wall 16 includes a receiving portion 20 having a flat trapezoidal shape and protruding down at a position facing the resilient contact piece 18. When the housing 60 is connected to an unillustrated mating connector housing, a male tab of an unillustrated mating terminal fitting mounted in the mating housing is inserted into the main body 11 and is sandwiched resiliently between the contact portion 19 and the receiving portion 20 while deflecting the resilient contact piece 18 so that the terminal fittings are connected electrically. Further, an auxiliary piece 21 in the form of a strip projects obliquely forward in the main body 11 by bending a cut piece from the base wall 14. The auxiliary piece 21 contacts the resilient contact piece 18 from below to resist excessive deflection of the resilient contact piece 18.

Figure 7:
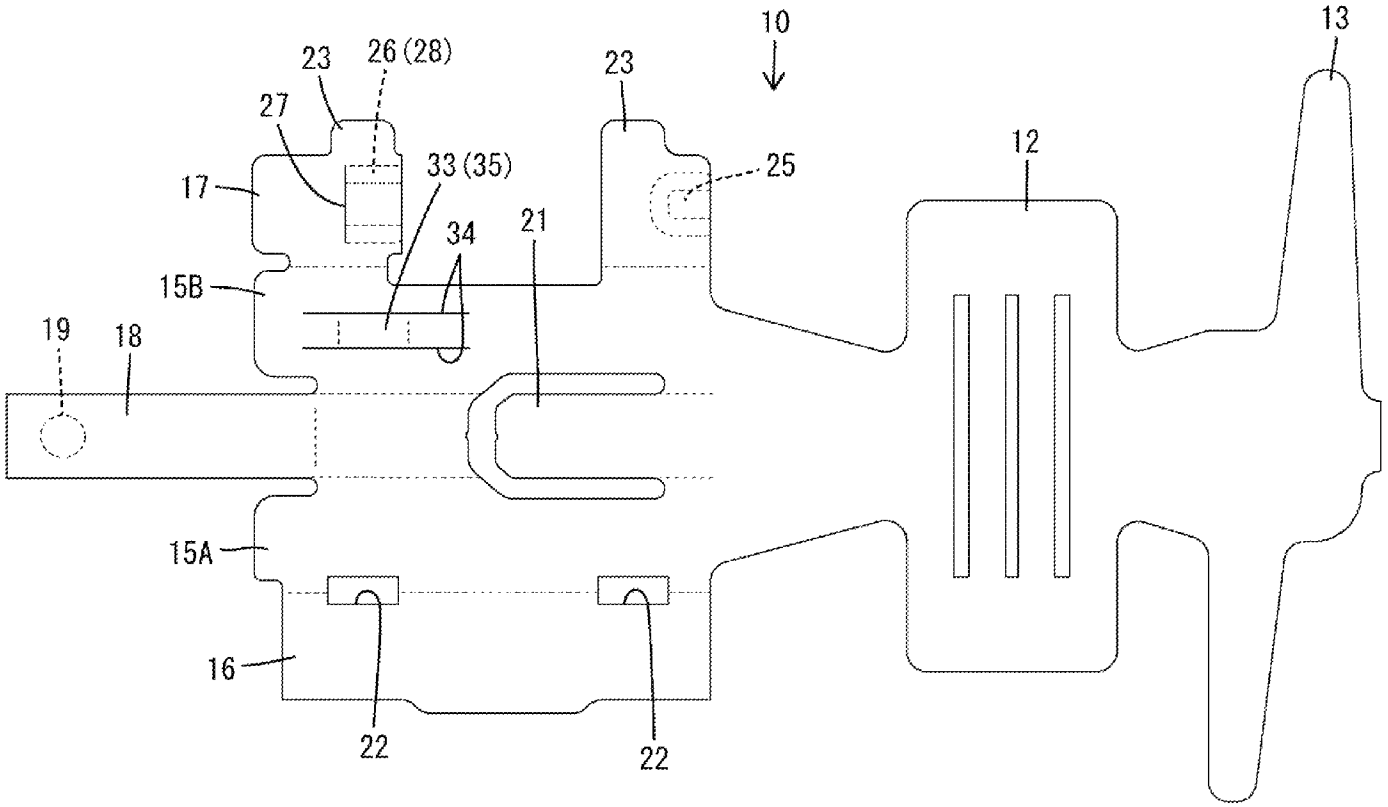
FIG. 7 is a development of the terminal fitting.

As shown in FIGS. 2 and 7, front and rear slit-like locking holes 22 are provided on a corner of the main body 11 where the first side wall 15A and the first bridging wall 16 are connected. Front and rear locking pieces 23 are provided on a tip of the second bridging wall 17 at positions corresponding to the two locking holes 22. The locking pieces 23 are inserted into the corresponding locking holes 22 and bent to keep the main body 11 in a tubular shape. Further, as shown in FIGS. 1 and 4, an opening hole 24 is provided over the entire width between the locking holes 23 in the front-back direction. As shown in FIG. 1, when the terminal fitting 10 is viewed from above, the upper surface of the first bridging wall 16 can be confirmed visually through the opening hole 24.

As shown in FIGS. 1 and 4, a locking projection 25 of substantially U-shaped cross-section bulges up on a substantially widthwise central part the rear edge of the second bridging wall 17. The rear edge of the locking projection 25 is provided at substantially the same position as the rear end of the main body 11 in the front-back direction, so that the rear edge can be locked by an unillustrated retainer to retain the terminal fitting 10 in the cavity 61 when the retainer is mounted into the housing 60.

The first stabilizer 26 projects up at a position facing the opening hole 24 on a front part of the second bridging wall 17 at opposite front and rear sides of the opening hole 24, as shown in FIGS. 1 and 4. A cut 27 is formed in a substantially widthwise central part of the second bridging wall 17 and extends substantially parallel to the front end of the opening hole 24, as shown in FIGS. 5 and 7. A plate piece 28 between the cut 27 and the front end of the opening hole 24 is struck up to form the first stabilizer 26 into a substantially U-shape.

Figure 3:
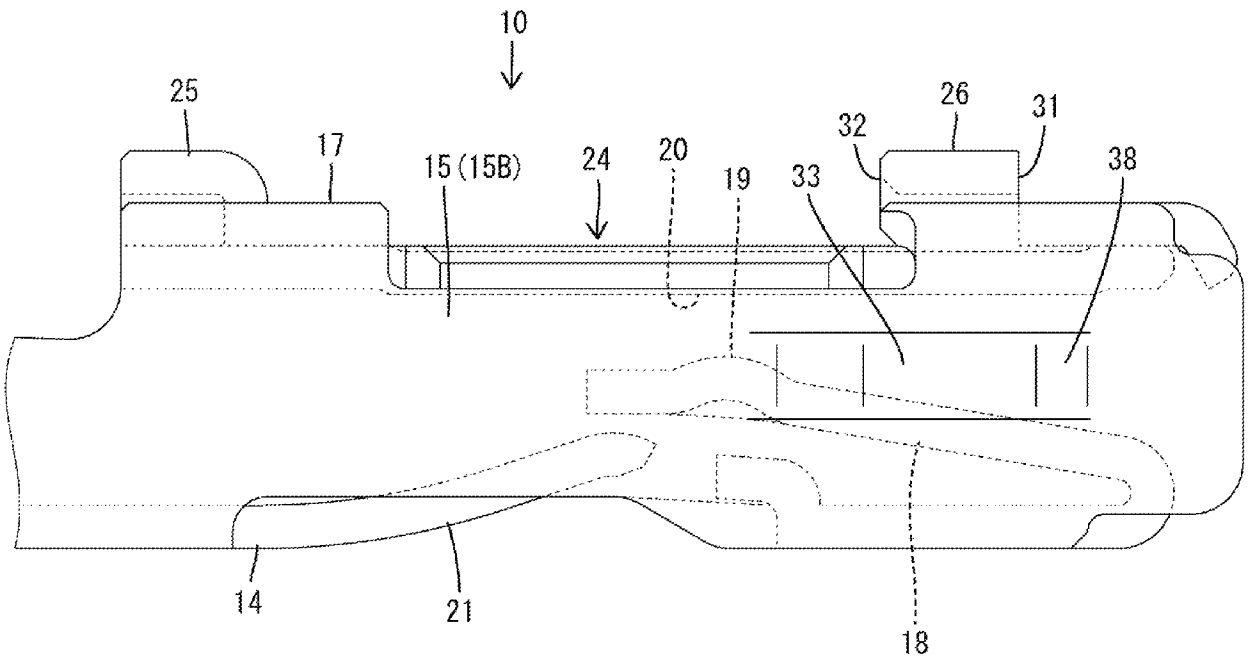
FIG. 3 is an enlarged right side view of an essential part of the terminal fitting.

As shown in FIG. 5, the first stabilizer 26 has a first tip 29 arranged substantially along a width direction in a widthwise central part and two first bases 30 are inclined toward and connected to the first tip portion 29 on opposite widthwise end sides. A front end part of the first stabilizer 26 is formed by a surface of the cut and bent plate piece 28 in a plate thickness direction and serves as a first restricting portion 31 capable of restricting insertion of the terminal fitting 10 when the terminal fitting 10 is in an incorrect insertion posture. The first restricting portion 31 is continuous and has a substantially trapezoidal shape from the first tip 29 to the first bases 30 when viewed from the front and, as shown in FIGS. 2 to 4, and stands up substantially perpendicular to the front-back direction when viewed laterally. Similarly, a rear end of the first stabilizer 26 is continuous and has a substantially trapezoidal shape from the first tip 29 to both first bases 30 when viewed from behind, and stands up substantially perpendicular to the front-back direction when viewed laterally. The rear end of the first stabilizer 26 is defines a lance receiving portion 32 that is resiliently lockable to the locking lance.

The second stabilizer 33 projects laterally on the second side wall 15B of the main body 11, as shown in FIGS. 3 to 5. More particularly, two parallel cuts 34 are formed in a substantially central part of the second side wall 15B in a height direction, and a strip 35 between the cuts 34 is struck to protrude laterally, thereby forming the second stabilizer 33 into a substantially U-shape, as shown in FIGS. 6 and 7.

Figure 6:
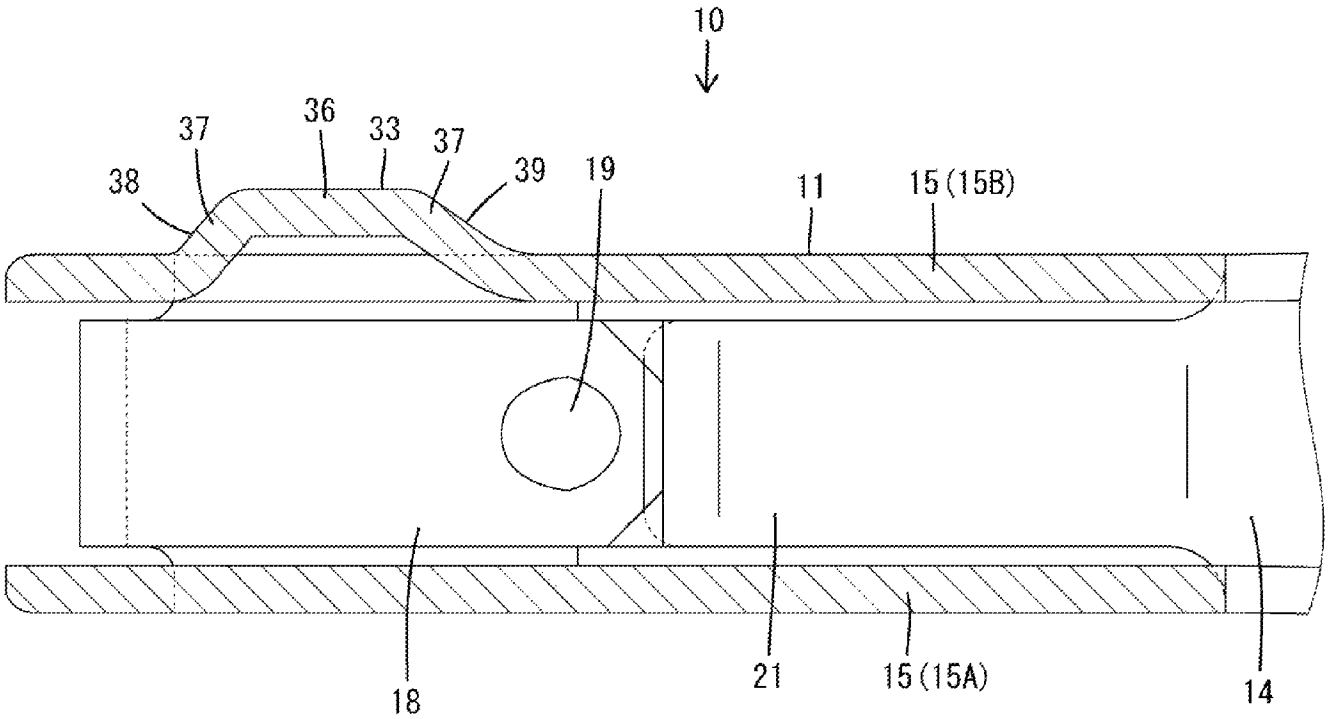
FIG. 6 is an enlarged horizontal section of an essential part of the terminal fitting.

Specifically, as shown in FIG. 6, the second stabilizer 33 is composed of a second tip 36 arranged in a substantially central part in the front-back direction and two second bases 37 incline toward and connect to the second tip 36 on opposite ends in the front-back direction. Front ends of the second bases 37 of the second stabilizer 33 are formed by a plate surface of the cut and bent strip 35 and define a tapered second restricting portion 38 that inclines to recede gradually when viewed from above. As shown in FIG. 8, the second restricting portion 38 of the second stabilizer 33 functions to restrict insertion of the terminal fitting 10 when the terminal fitting 10 is in an incorrect insertion posture. Rear parts of the second bases 37 of the second stabilizer 33 also are formed by the plate surface of the cut and bent strip 35 and form a tapered surface 39 that inclines gradually forward when viewed from above. An angle of inclination of the second restricting portion 38 with respect to the front-back direction is larger than that of the inclined surface 39 with respect to the front-back direction.

The first and second stabilizers 26 and 33 are arranged at positions overlapping each other in the front-back direction, as shown in FIGS. 1 to 4. Specifically, the first stabilizer 26 is at a position within a length range of the second stabilizer 33 in the front-back direction. The front end of the second restricting portion 38 of the second stabilizer 33 is located before the first restricting portion 31 of the first stabilizer 26. Specifically, the second restricting portion 38 of the second stabilizer 33 is located entirely before the first restricting portion 31 of the first stabilizer 26.

The terminal fitting 10 is inserted into the cavity 61 of the housing 60 from behind. In the process of inserting the terminal fitting 10 into the cavity 61, the second restricting portion 38 of the second stabilizer 33 is inserted into the guide groove 66 and the first restricting portion 31 of the first stabilizer 26 is inserted into the guiding groove 66 at a slightly later timing. When the inserting operation of the terminal fitting 10 further continues, the first and second stabilizers 26, 33 slide on groove surfaces of the corresponding guiding grooves 66 to guide the inserting operation of the terminal fitting 10. When the terminal fitting 10 is inserted properly into the cavity 61, the locking lance is locked to the lance receiving portion 32 of the main body 11 to hold the terminal fitting 10 in the cavity 61.

The terminal fitting 10 may not be in a correct insertion posture during an insertion process, and may, for example, be in a vertically inverted posture. In this case, the second restricting portion 38 of the second stabilizer 33 contacts the guiding surface 65 of the housing 60 without being inserted into the guiding groove 66, thereby preventing any further insertion of the terminal fitting 10. Thus, the incorrect insertion posture is known when the inserting operation of the terminal fitting 10 is restricted, and the insertion of the terminal fitting 10 into the cavity 61 in an incorrect posture can be prevented. Further, the tapered second restricting portion 38 of the second stabilizer 33 is not likely to damage the guiding surface 65 of the housing 60.

Insertion of the improperly oriented terminal fitting 10 is stopped by the contact of the second restricting portion 38 of the second stabilizer 33 with the guiding surface 65 of the housing 60. However, the guiding surface 65 of the housing 60 is tapered to have a smaller diameter toward the front, and the second restricting portion 38 of the second stabilizer 33 may possibly slide on the guiding surface 65 without stopping the inserting operation of the terminal fitting 10.

In this embodiment, even if the second restricting portion 38 of the second stabilizer 33 slides on the guiding surface 65, the first restricting portion 31 of the first stabilizer 26 contacts the guiding surface 65 immediately thereafter to prevent any further insertion of the terminal fitting 10. The first restricting portion 31 of the first stabilizer 26 extends steeply in the direction substantially perpendicular to the front-back direction. Thus, the inserting operation of the terminal fitting 10 is stopped with high reliability, and the insertion of the terminal fitting 10 in an incorrect posture into the cavity 61 can be prevented reliably. Further, a contact force (impact force) of the first stabilizer 26 with the housing 60 is suppressed by the second restricting portions 38 of the second stabilizer 33 contacting the guiding surface 65 earlier than the first restricting portion 31. Thus, there is little likelihood of damaging the guiding surface 65 of the housing 60. As a result, the inverted insertion preventing function of the terminal fitting 10 can be exhibited with no problem.

The first stabilizer 26 is formed by cutting and bending the plate 28 extending up to the cut 27 formed on the main body 11 and the first restricting portion 31 of the first stabilizer 26 is formed by the surface of the plate 28 in the plate thickness direction. Thus, the first restricting portion 31 can be produced easily to extend steeply in the direction substantially perpendicular to the front-back direction.

The first stabilizer 26 also functions as the lance receiving portion 32 so that the entire configuration can be simplified as compared with the case where a dedicated lance receiving portion 32 is provided separately.

The rear part 63 of the cavity 61 of the housing 60 forms the rubber plug accommodating portion 67 with a larger diameter than the front part 62, and the intermediate part 64 of the cavity 61 of the housing 60 defines the tapered guiding surface 65 with a gradually reduced diameter from the rear part 63 to the front part 62. Thus, there is a possibility that the second restricting portions 38 of the second stabilizer 33 will slide on the guiding surface 65 without stopping the insertion of the terminal fitting 10 in an incorrect posture. However, as described above, the first restricting portion 31 of the first stabilizer 26 will contact the guiding surface 65 to stop the insertion of the improperly oriented terminal fitting 10 with high reliability. Therefore inverted insertion of the terminal fitting 10 is prevented with high reliability.

The invention is not limited to the above described embodiment. For example, the following embodiments also are included in the scope of the invention.

The facing wall surface of the housing with which the stabilizer can come into contact is not limited to the above guiding surface and may be an opening edge of the cavity on the rear surface of the housing.

The rear ends of the second restricting portion of the second stabilizer may be behind the first restricting portion of the first stabilizer provided that the second restricting portion of the second stabilizer contacts the facing wall surface of the housing earlier than the first stabilizer when the terminal fitting is in an incorrect insertion posture.

Three or more stabilizers including the first and second stabilizers may project on the main body.

The insulation barrel may be connected by crimping to the coating on the end part of the wire rather than to the rubber plug.

LIST OF REFERENCE SIGNS

10 . . . terminal fitting
11 . . . main body

26 . . . first stabilizer
27 . . . cut
28 . . . plate piece part
31 . . . first restricting portion (front end part of first stabilizer)
32 . . . lance receiving portion
33 . . . second stabilizer
38 . . . second restricting portion (front end part of second stabilizer)
60 . . . connector housing
61 . . . cavity
62 . . . front part
63 . . . rear part
65 . . . guiding surface
66 . . . guiding groove
67 . . . rubber plug accommodating portion

What is claimed is:

1. A terminal fitting, comprising a tubular main body to be inserted into a cavity of a housing from behind, first and second stabilizers projecting on the main body while being spaced apart in a direction intersecting a front-back direction, insertion of the terminal fitting into the cavity being guided by the stabilizers in guiding grooves communicating with the cavity in the housing and being prevented by contact of a front end of at least one of the stabilizers with a facing wall surface of the housing when an insertion posture is incorrect, wherein:

the first stabilizer being formed by cutting and bending a part of the main body and having a front end formed by an edge of a plate of the terminal fitting in a plate thickness direction, the front end of the first stabilizer extending steeply in a direction substantially perpendicular to the front-back direction, a rear end of the first stabilizer defines a lance receiving portion that contacts a locking lance formed in the cavity of the housing to prevent the terminal fitting from coming out of the cavity and the second stabilizer having a front end inclined to recede; and a front end position of the front end of the second stabilizer is before the first stabilizer so that the front end of the second stabilizer contacts the facing wall surface of the housing earlier than the first stabilizer when the insertion posture is incorrect.

2. A connector with the terminal fitting of claim 1, wherein a rear part of the cavity of the housing is formed as a rubber plug accommodating portion having a larger diameter than a front part, the cavity of the housing is formed with a tapered guiding surface gradually reduced in diameter from the rear part toward the front part, and the front end part of at least one of the stabilizers contacts the guiding surface when the main body is in an incorrect insertion posture.

3. A terminal fitting formed from a metal plate and having opposite front and rear ends spaced apart along a longitudinal direction and a tubular main body adjacent the front end, the main body comprising:

a first stabilizer projecting out from a first wall of the main body and having a front end defined by an edge of the metal plate that is aligned at a first angle that is substantially perpendicular to the longitudinal direction and spaced from the front end by a first distance, the first stabilizer further having a rear end aligned substantially perpendicular to the longitudinal direction for defining a lance receiving portion that contacts a locking lance formed in a cavity of a housing to prevent the terminal fitting from coming out of the cavity; and a second stabilizer projecting out from a second wall of the main body that intersects the first wall, the second stabilizer having a front end defined by a surface of the metal plate and being aligned at a second angle to the longitudinal direction and spaced from the front end by a second distance, the second distance being less than the first distance and the second angle being sloped more gradually than the first angle.

* * * * *